US006552690B2

(12) United States Patent
Veerasamy

(10) Patent No.: US 6,552,690 B2
(45) Date of Patent: Apr. 22, 2003

(54) VEHICLE WINDSHIELD WITH FRACTAL ANTENNA(S)

(75) Inventor: Vijayen S. Veerasamy, Farmington Hills, MI (US)

(73) Assignee: Guardian Industries Corp., Auburn Hills, MI (US)

( * ) Notice: Subject to any disclaimer, the term of this patent is extended or adjusted under 35 U.S.C. 154(b) by 0 days.

(21) Appl. No.: 09/928,976

(22) Filed: Aug. 14, 2001

(65) Prior Publication Data

US 2003/0034926 A1 Feb. 20, 2003

(51) Int. Cl.[7] ..... H01Q 1/32
(52) U.S. Cl. ..... 343/713; 343/700 MS; 343/711
(58) Field of Search ..... 343/712, 711, 343/713, 893, 878, 700 MS

(56) References Cited

U.S. PATENT DOCUMENTS

| | | | | |
|---|---|---|---|---|
| 3,641,580 A | | 2/1972 | Monser | 343/895 |
| 3,794,809 A | | 2/1974 | Beck et al. | 219/203 |
| 4,356,496 A | | 10/1982 | Wolfson et al. | 343/854 |
| 4,782,216 A | | 11/1988 | Woodward | 219/547 |
| 4,820,902 A | | 4/1989 | Gillery | 219/203 |
| 4,894,513 A | | 1/1990 | Koontz | 219/203 |
| 4,954,797 A | | 9/1990 | Shinnai et al. | 343/704 |
| 5,119,103 A | | 6/1992 | Evans et al. | 342/423 |
| 5,298,048 A | | 3/1994 | Lingle et al. | 65/60.2 |
| 5,324,374 A | | 6/1994 | Harmand et al. | 156/102 |
| 5,355,144 A | * | 10/1994 | Walton et al. | 343/713 |
| 5,355,318 A | * | 10/1994 | Dionnet et al. | 156/275.5 |
| 5,357,260 A | | 10/1994 | Roederer et al. | 343/754 |
| 5,457,465 A | | 10/1995 | Collier et al. | 342/374 |
| 5,495,261 A | | 2/1996 | Baker et al. | 343/846 |

(List continued on next page.)

FOREIGN PATENT DOCUMENTS

| | | |
|---|---|---|
| EP | 0 297 813 | 1/1989 |
| EP | 0 358 090 | 3/1990 |
| WO | WO 01/22528 | 3/2001 |
| WO | WO 01/31747 | 5/2001 |
| WO | WO 01/54225 | 7/2001 |

OTHER PUBLICATIONS

"Fractal Design of Multiband and Low Side–Lobe Arrays", Puente–Baliarda et al., 1996 IEEE, May 5, 1996 pp. 730–739.

"Wave Interactions with Generated Cantor Bar Fractal Multilayers", Sun et al., Jun. 6, 1991, pp. 2500–2507.

"Scattering From Bandlimited Fractal Fibers", Jaggard et al., IEEE, Dec. 12, 1989, pp. 1591–1597.

"Fractal Surface Scattering: A Generalized Rayleigh Solution", Jaggard et al., Aug. 16, 1990, pp. 5456–5462.

"On the Synthesis of Fractal Radiation Patterns", Werner et al., Jan–Feb. 1995, pp. 29–45.

(List continued on next page.)

*Primary Examiner*—Don Wong
*Assistant Examiner*—Shih-Chao Chen
(74) *Attorney, Agent, or Firm*—Nixon & Vanderhye P.C.

(57) ABSTRACT

A fractal antenna is patterned out of a conductive layer (e.g., Cu, Au, ITO, etc.), and is provided between first and second opposing substrates of a vehicle windshield. A polymer inclusive interlayer functions to both protect the fractal antenna(s) and laminate the opposing substrates to one another. In other embodiments, a multiband fractal antenna is provided which includes a first group of triangular shaped antenna portions, and a second triangular shaped antenna portion(s), wherein each of the triangular shaped antenna portions of the first group is located within a periphery of the second triangular shaped antenna portion. The first group of antenna portions transmits and/or receives at a first frequency band, while the second antenna portion(s) transmits and/or receives at a second frequency band different than the first band.

22 Claims, 12 Drawing Sheets

U.S. PATENT DOCUMENTS

| | | | | |
|---|---|---|---|---|
| 5,557,462 | A | 9/1996 | Hartig et al. | 359/585 |
| 5,905,466 | A | 5/1999 | Jha | 343/700 MS |
| 6,049,312 | A | 4/2000 | Lord et al. | 343/781 P |
| 6,081,235 | A | 6/2000 | Romanofsky et al. | 343/700 MS |
| 6,104,349 | A | 8/2000 | Cohen | 343/702 |
| 6,107,975 | A | 8/2000 | Brennan et al. | 343/853 |
| 6,127,977 | A | 10/2000 | Cohen | 343/700 MS |
| 6,140,975 | A | 10/2000 | Cohen | 343/846 |
| 6,169,925 | B1 | 1/2001 | Villaseca et al. | 607/60 |
| 6,300,914 | B1 * | 10/2001 | Yang | 343/702 |
| 6,384,790 | B2 * | 5/2002 | Dishart et al. | 343/713 |

OTHER PUBLICATIONS

"Time–Harmonic and Time–Dependent Radiation by Bifractal Dopole Arrays", Lakhtakia et al., 1987, pp. 819–824.

"Spatial Spectrum of a General Family of Self–Similar Arrays", Allain et al., Dec. 15, 1987, pp. 5752–5757.

"Theory and Application of Pascal–Sierpinski Gasket Fractals", Bedrosian et al., 1990, pp. 148–159.

"Aggregation Under a Forced Convective Flow", Lopez–Tomas et al., Nov. 1992, pp. 11495–11500.

A Re–Examination of the Fundamental Limits on the Radiation Q of Electrically Small Antennas, McLean, May 1996, pp. 672–676.

"Multiparticle Diffusive Fractal Aggregation", Voss, Jul. 1984, pp. 334–337.

"Quasi–Two–Dimensional Electrodeposition Under Forced Fluid Flow", Lopez–Tomas et al., Dec. 1993, pp. 4373–4376.

"The Degradation of Coatings by Ultraviolet Light and Electromagnetic Radiation", Journal of Protective Coatings & Linings, May 1992, Anatomy of Paint, Clive H. Hare, Editor, Materials Technology Section.

* cited by examiner

3-Dimensional Fractal Tree Dipole Antennas
Benefit: Decreased Resonant Frequency
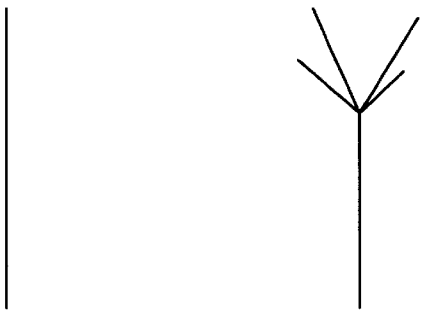
Iteration 0
Fig. 10(a)
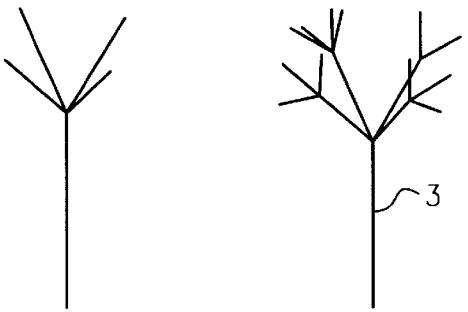
Iteration 1
Fig. 10(b)
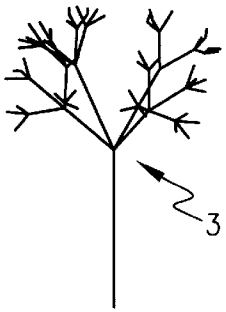
Iteration 2
Fig. 10(c)
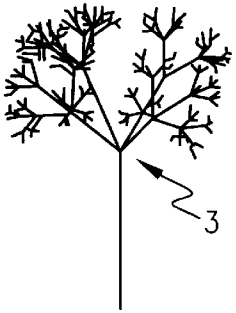
Iteration 3
Fig. 10(d)
Iteration 4
Fig. 10(e)
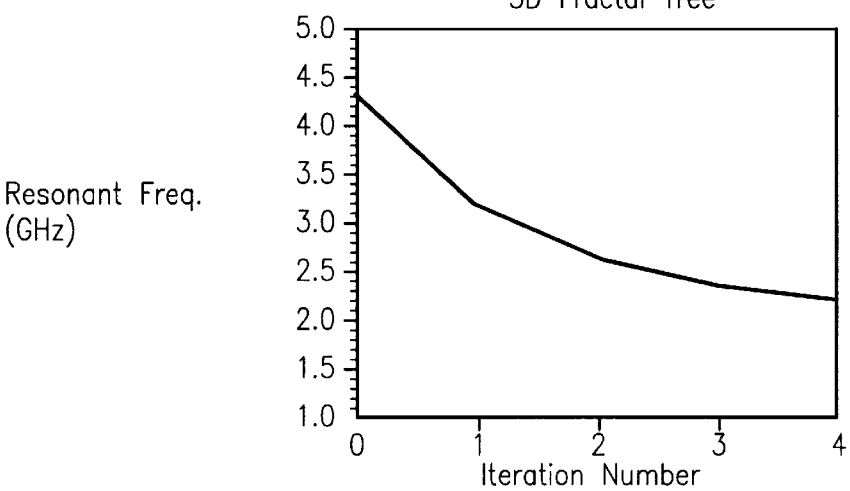
Fig. 10(f)

VEHICLE WINDSHIELD WITH FRACTAL ANTENNA(S)

BACKGROUND OF THE INVENTION

This invention relates to fractal antenna(s) (or antennae). More particularly, one embodiment of this invention relates to a vehicle windshield including a fractal antenna(s). Another embodiment of this invention relates to a multiband fractal antenna. Yet another embodiment of this invention relates to an array of fractal antennas.

Generally speaking, antennas radiate and/or receive electromagnetic signals. Design of antennas involves balancing of parameters such as antenna size, antenna gain, bandwidth, and efficiency.

Most conventional antennas are of Euclidean design/geometry, where the closed antenna area is directly proportional to the antenna perimeter. Thus, for example, when the length of a Euclidean square is increased by a factor of three, the enclosed area of the antenna is increased by a factor of nine. Unfortunately, Euclidean antennas are less than desirable as they are susceptible to high Q factors, and become inefficient as their size gets smaller.

Characteristics (e.g., gain, directivity, impedance, efficiency) of Euclidean antennas are a function of the antenna's size to wavelength ratio. Euclidean antennas are typically designed to operate within a narrow range (e.g., 10–40%) around a center frequency "fc" which in turn dictates the size of the antenna (e.g., half or quarter wavelength). When the size of a Euclidean antenna is made much smaller than the operating wavelength ($\lambda$), it becomes very inefficient because the antenna's radiation resistance decreases and becomes less than its ohmic resistance (i.e., it does not couple electromagnetic excitations efficiently to free space). Instead, it stores energy reactively within its vicinity (reactive impedance Xc). These aspects of Euclidean antennas work together to make it difficult for small Euclidean antennas to couple or match to feeding or excitation circuitry, and cause them to have a high Q factor (lower bandwidth). Q factor may be defined as approximately the ratio of input reactance to radiation resistance ($Q \approx X_{in}/R_r$). The Q factor may also be defined as the ratio of average stored electric energies (or magnetic energies stored) to the average radiated power. Q can be shown to be inversely proportional to bandwidth. Thus, small Euclidean antennas have very small bandwidth, which is of course undesirable (e.g., tuning circuitry may be needed).

Many known Euclidean antennas are based upon closed-loop shapes. Unfortunately, when small in size, such loop-shaped antennas are undesirable because, as discussed above, e.g., radiation resistance decreases significantly when the antenna size/area is shortened/dropped. This is because the physical area ("A") contained within the loop-shaped antenna's contour is related to the latter's perimeter. Radiation resistance (R_r) of a circular (i.e., loop-shaped) Euclidean antenna is defined by ("k" is a constant):

$$R_r=\eta(2/3)\pi(kA/\lambda)^2=20\pi^2(C/\lambda)^4 \quad (1)$$

Since ohmic resistance (R_c) is only proportional to perimeter (C), then for C<1, the ohmic resistance (R_c) is greater than the radiation resistance (R_r) and the antenna is highly inefficient. This is generally true for any small circular Euclidean antenna. In this regard, it is stated in U.S. Pat. No. 6,104,349 (hereby incorporated herein by reference) at column 2, lines 14–19 that "small-sized antennas will exhibit a relatively large ohmic resistance O and a relatively small radiation resistance R, such that resultant low efficiency defeats the use of the small antenna."

Fractal geometry is a non-Euclidean geometry which can be used to overcome the aforesaid problems with small Euclidean antennas. Again, see the '349 Patent in this regard. Radiation resistance R_r of a fractal antenna decreases as a small power of the perimeter (C) compression, with a fractal loop or island always having a substantially higher radiation resistance than a small Euclidean loop antenna of equal size. Accordingly, fractals are much more effective than Euclideans when small sizes are desired. Fractal geometry may be grouped into (a) random fractals, which may be called chaotic or Brownian fractals and include a random noise component, and (b) deterministic or exact fractals. In deterministic fractal geometry, a self-similar structure results from the repetition of a design or motif (or "generator") (i.e., self-similarity and structure at all scales). In deterministic or exact self-similarity, fractal antennas may be constructed through recursive or iterative means as in the '349 Patent. In other words, fractals are often composed of many copies of themselves at different scales, thereby allowing them to defy the classical antenna performance constraint which is size to wavelength ratio.

Recent growth in technology such as the Internet, cellular telecommunications, and the like has led to personal users desiring wireless access for: Internet access, cell phones, pagers, personal digital assistants, etc., while competing types of wireless broadband such as TDMA (time division multiple access), CDMA (code division multiple access) and GSM are being pushed by wireless manufacturers. Unfortunately, current vehicle antenna systems do not have the capability of efficiently enabling such desired wireless access.

In view of the above, it will be apparent that there exists a need in the art for a vehicle antenna system that enables efficient access to the Internet, cell phones, pagers, personal digital assistants, radio, and/or the like. There also exists a need in the art for a multiband fractal antenna. These and other needs which will become apparent to the skilled artisan from a review of the instant application are achieved by the instant invention(s).

BRIEF SUMMARY OF THE INVENTION

An object of this invention is to provide a vehicle windshield including a fractal antenna therein.

Another object of this invention is to provide a system including an array of fractal antennas (or antennae).

Another object of this invention is to provide a multiband fractal antenna.

Another object of this invention is to fulfill one or more of the above-listed objects and/or needs.

In certain example embodiments, this invention fulfills one or more of the above-listed objects and/or needs by providing a vehicle windshield comprising:

first and second substrates laminated to one another via at least a polymer inclusive interlayer; and at least one fractal antenna located at least partially between said first and second substrates.

In other embodiments of this invention, one or more of the above-listed needs and/or objects is fulfilled by providing a method of making a vehicle windshield, the method comprising:

providing first and second substrates;

forming a first conductive layer on the first substrate;

forming a resist on the first substrate over the first conductive layer;

patterning the first conductive layer into a shape of a fractal antenna using the resist, thereby leaving the fractal antenna on the first substrate; and laminating the first substrate with fractal antenna thereon to the second substrate via a polymer inclusive interlayer.

In still further embodiments of this invention, one or more of the above-listed needs is fulfilled by providing a multiband fractal antenna comprising a first group of isosceles triangular shaped antenna portions of a first size;

a second group of isosceles triangular shaped antenna portions of a second size larger than said first size;

a third triangular shaped isosceles antenna portion of a third size larger than said first and second sizes;

wherein each of said triangular shaped antenna portions of said first and second groups is located within a periphery of said third triangular shaped antenna portion so as to provide a multiband fractal antenna.

In certain embodiments, said first group of triangular shaped antenna portions transmits and/or receives at a first frequency band, said second group of triangular shaped antenna portions transmits and/or receives at a second frequency band different than said first band, and said third triangular shaped antenna portion transmits and/or receives at a third frequency band different than said first and second bands. The portions may be shaped as isosceles triangles in certain embodiments.

Certain embodiments of this invention further fulfill one or more of the above-listed objects and/or needs by providing a method of making a vehicle window, the method comprising:

forming a fractal conductive antenna layer on a polymer inclusive film, said polymer inclusive film also supporting an adhesive layer and a release layer;

removing the release layer, and adhering the polymer inclusive film with the fractal conductive antenna layer thereon to a substrate; and laminating the substrate to another substrate via a polymer inclusive interlayer in the process of forming a vehicle window.

Other embodiments fulfill one or more of the above-listed needs by providing a method of making a vehicle window, the method comprising:

forming a fractal layer on a polymer inclusive layer; and laminating first and second substrates to one another via the polymer inclusive layer so that following said laminating the fractal layer is sandwiched between the substrates.

BRIEF DESCRIPTION OF THE DRAWINGS

FIG. 5(*b*) is a cross sectional view of a photoresist applied on the substrate and conductive layer of FIG. 5(*a*), during the process of manufacturing a fractal antenna system according to an embodiment of this invention.

FIG. 5(*c*) is a cross sectional view of a fractal antenna formed on the substrate of FIGS. 5(*a*) and 5(*b*), during the process of manufacturing a fractal antenna system according to an embodiment of this invention.

FIG. 8(*b*) is a frequency (MHz) vs. Input Resistance (ohms) graph illustrating that the different antennas of FIG. 8(*a*) take up the same volume but the input impedance of the fractal antenna (Koch loop) is much higher, especially as frequency increases.

FIGS. 10(*a*), 10(*b*), 10(*c*), 10(*d*) and 10(*e*) illustrate increasing iterations of a fractal design, wherein any of the fractal inclusive iterations (i.e., iteration two or higher) may be used in any of the FIG. 1–4 embodiments of this invention.

FIG. 10(*f*) is a resonant frequency vs. iteration number graph relating to the iterations of FIGS. 10(*a*) through 10(*e*), illustrating that resonance decreases as iterations increase.

DETAILED DESCRIPTION OF CERTAIN EXAMPLE EMBODIMENTS OF THE INVENTION

Certain embodiments of this invention relate to a fractal antenna printed on a dielectric substrate (e.g., glass substrate or other suitable substrate). Other embodiments of this invention relate to a vehicle windshield with a fractal antenna(s) provided therein. Other embodiments of this invention relate to a multiband fractal antenna. Other embodiments of this invention relate to an array of fractal antennas provided on a substrate. Certain other embodiments of this invention relate to a method of making fractal antennas (or antennae), or arrays thereof. While fractal antennas are illustrated and described herein as being used in the context of a vehicle windshield, the invention is not so limited as certain fractals (e.g., multiband fractal antennas) may be used in other contexts where appropriate and/or desired. Moreover, in certain embodiments of this invention fractals herein may be used as cell phone, pager, or personal computer (PC) antennas.

Figure 1:
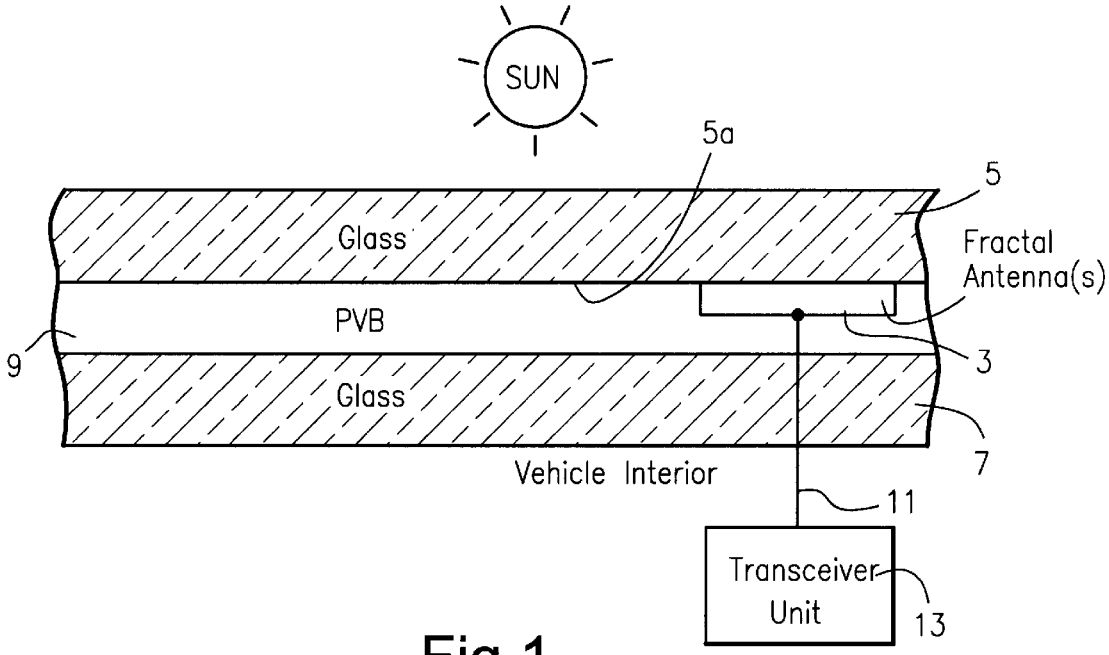
FIG. 1 is a side cross sectional view of a vehicle windshield including a fractal antenna according to an embodiment of this invention (taken along section line A–A' in FIG. 3).

FIG. 1 is a cross sectional view of a vehicle windshield (see section line A–A' in FIG. 3) including a fractal antenna 3, according to an embodiment of this invention. The windshield (curved or flat) includes first glass substrate 5 on the exterior side of the windshield, second glass substrate 7 on the interior side of the windshield adjacent the vehicle interior, polymer interlayer 9 for laminating the substrates 5, 7 to one another, and fractal antenna(s) 3. Polymer inclusive interlayer 9 may be of or include polyvinyl butyral (PVB), polyurethane (PU), PET, polyvinylchloride (PVC), or any other suitable material for laminating substrates 5 and 7 to one another. Substrates 5 and 7 may be flat in certain embodiments, or bent/curved in other embodiments in the shape of a curved vehicle windshield. Substrates 5 and 7 are preferably of glass such as soda-lime-silica type glass, but may be of other materials (e.g., plastic, borosilicate glass, etc.) in other embodiments of this invention.

As shown in FIG. 1, the fractal antenna includes a conductive layer 3 provided on the interior surface of substrate 5. Fractal antenna layer 3 may be of or include opaque copper (Cu), gold (Au), substantially transparent indium-tin-oxide (ITO), or any other suitable conductive material in different embodiments of this invention. Transparent conductive oxides (TCOs) are preferred for fractal antenna layer 3 in certain embodiments; example TCOs include ITO, SnO, AlZnO, RuO, etc. Layer 3 is patterned into the shape of a fractal antenna (explained below), and may be fractal shaped as illustrated for example in any of FIGS. 6–12. Any other suitable fractal shape may be used for antenna 3 (e.g., see the fractal shapes disclosed in U.S. Pat. Nos. 6,104,349, 6,140,975 and 6,127,977, the disclosures of which are hereby incorporated herein by reference) in alternative embodiments of this invention. As shown in FIG. 1, the first major surface of fractal antenna layer 3 contacts dielectric substrate 5 while the other major surface of layer 3 contacts insulative polymer inclusive interlayer 9. Interlayer 9 functions to both protect fractal antenna layer 3, and laminate the opposing substrates 5 and 7 to one another. Interlayer 9 is substantially transparent (i.e., at least about 80% transparent to visible light) in certain embodiments of this invention.

Overall, the laminated windshield (excluding layer 3 in some embodiments) of FIG. 1 is preferably at least about 70% transmissive of visible light, and more preferably at least about 75% transmissive of visible light. When fractal antenna layer 3 includes copper, then the small area of the windshield where the fractal is located is preferably opaque to visible light. However, when fractal antenna layer 3 includes ITO or some other substantially transparent conductive material, the portion of the windshield including layer 3 is preferably at least about 60% transmissive of visible light, more preferably at least about 70% transmissive of visible light, and most preferably at least about 75% transmissive of visible light (i.e., so that the fractal antenna 3 is hard to visually see and is not aesthetically non-pleasing).

In the FIG. 1 embodiment, fractal antenna 3 is shown as being located directly on the interior surface 5*a* of substrate 5. However, in other embodiments of this invention, the fractal antenna 3 may be located on substrate 5 with one or more additional layer(s) being provided therebetween. In other embodiments to be described below, fractal antenna(s) may be printed on a PVB layer located between the substrates, or located on a polymer inclusive film located between the substrates. In all of these scenarios, antenna 3 is considered to be "on" and "supported by" substrate 5.

Fractal antenna(s) 3 may be in electrical or electromagnetic communication with the vehicle's radio system, so as to receive radio (e.g., FM, AM, digital, satellite, etc.) signals which may be reproduced via speaker(s) inside the vehicle. In such a scenario, the fractal antenna 3 receives the radio signals and couples the same as alternating current (AC) into a cable 11 so that the signal can be demodulated and used in electrical equipment 13 such as a vehicle radio. Additionally, or instead, fractal antenna(s) 3 may be in electrical or electromagnetic communication with other electrical equipment 13 such as a pager, cell phone, personal computer (PC), or the like inside the vehicle so as to transmit/receive signals on behalf of the same. For example, fractal antenna(s) 3 may transmit/receive RF signals (e.g., coded via TDMA, CDMA, WCDMA (wideband CDMA), GSM, or the like) through atmospheric free space to a local base station(s) (BS) of a cellular telecommunications network so as to enable a cell phone(s) inside the vehicle to communicate with other phones via the network. In a similar manner, fractal antenna (s) may transmit/receive signals through atmospheric free space (i.e., wireless) so as to enable a cell phone, pager, PC or the like inside the vehicle to access the Internet in a wireless manner. Cell phones, pagers, PCs, etc. inside the vehicle may be in communication with fractal antenna(s) 3 via a hardwire connection (e.g., via an adapter plug inside the vehicle) or in a wireless manner in different embodiments of this invention. Antenna(s) 3 may transmit/receive on one or multiple frequencies in different embodiments of this invention. Fractals 3 herein may transmit and/or receive on any suitable frequency (e.g., 850–900 MHz, 50–100 MHz, etc.). Undesired frequencies may be filtered out in certain embodiments, or alternatively a neural network could be used for multiplexing purposes.

Because fractal antennas 3 herein may be printed on a substrate (e.g., glass substrate), the dielectric nature of the substrate may slightly change the effective dimension of the antenna by slowing electromagnetic wave(s) passing therethrough. This may cause the antenna to look bigger than it actually is. However, it has been found that this effect can be compensated for by, for example, using the following equation: $\lambda_e=\lambda/\sqrt{[0.5(\in+1)]}$. As with dipoles, loops may use balun to generate positive and negative feeds for the antenna 3. For example, a coplanar strip feed can be used as a balun, the strip including two transmission lines that are 180 degrees out of phase with one another. A microstrip feed and delay line may be used to feed the coplanar strip line out of phase.

Figure 2:
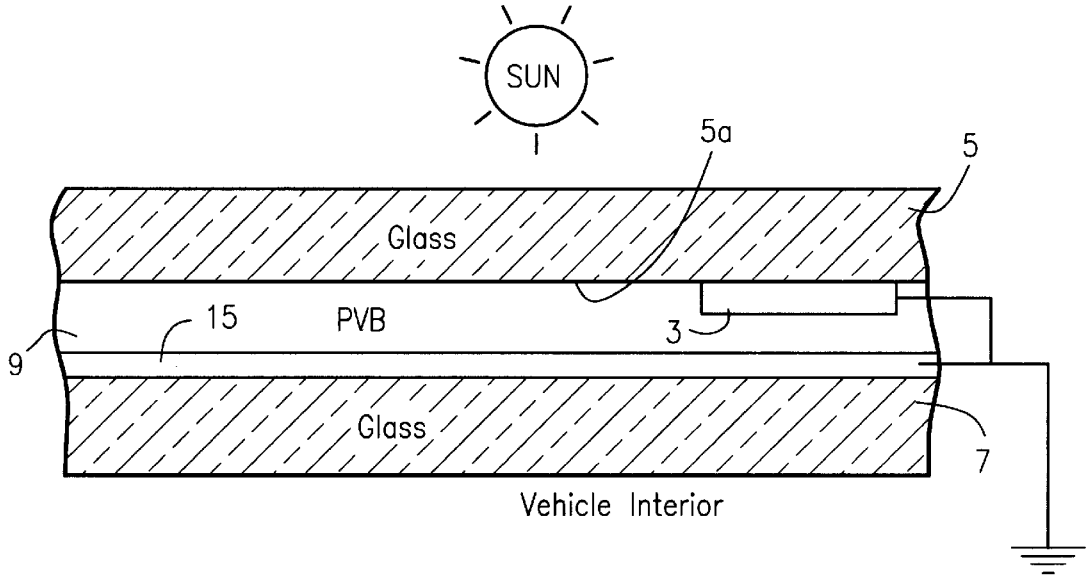
FIG. 2 is a side cross sectional view of a vehicle windshield including a fractal antenna according to another embodiment of this invention (taken along section line A–A' in FIG. 3).

FIG. 2 is a cross sectional view (see section line A–A' in FIG. 3) of a vehicle windshield according to another embodiment of this invention. The FIG. 2 embodiment is the same as the FIG. 1 embodiment described above, except that a low-E coating system 15 is provided on the interior surface of substrate 7 and the fractal antenna 3 is provided on the interior surface of substrate 5. Thus, it can be seen that the fractal antenna and low-E coating system are located opposite one another on opposing substrates, with the polymer interlayer 9 therebetween. One fractal 3, or any array of fractals 3, may be provided on the interior surface of substrate 5. With regard to coating 15, any suitable low-E coating may be used (e.g., see the coatings of U.S. Pat. Nos. 4,782,216, 5,557,462, 5,298,048 and U.S. patent application Ser. No. 09/794,224, all of which are hereby incorporated herein by reference). Low-E coating 15 may include one or more layers, and preferably includes at least one IR (infrared) reflecting conductive layer (e.g., of Ag). In certain embodiments of this invention, the Ag layer(s) of coating 15 may be used as a ground plane of fractal antenna 3 (see FIG. 2).

Surprisingly, it has been found that when fractal(s) 3 is supported by exterior substrate 5 and low-E coating 15 (coating 15 may include one or more layers) is supported by the opposite or interior substrate 7, the Ag layer(s) of coating 15 function to reflect electromagnetic waves incident from outside the vehicle back toward fractal(s) 3 (i.e. coating 15 acts as a counterprise) in order to enhance fractal performance.

Figure 3:
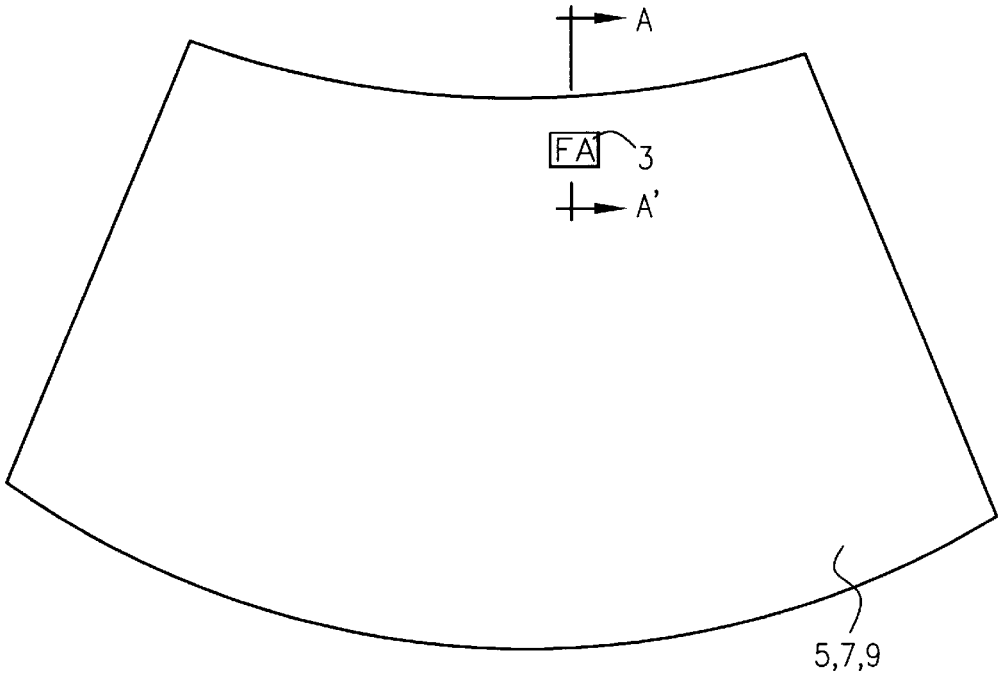
FIG. 3 is a plan view of a vehicle windshield including a fractal antenna according to either the FIG. 1 or FIG. 2 embodiment(s) of this invention.
Figure 4:
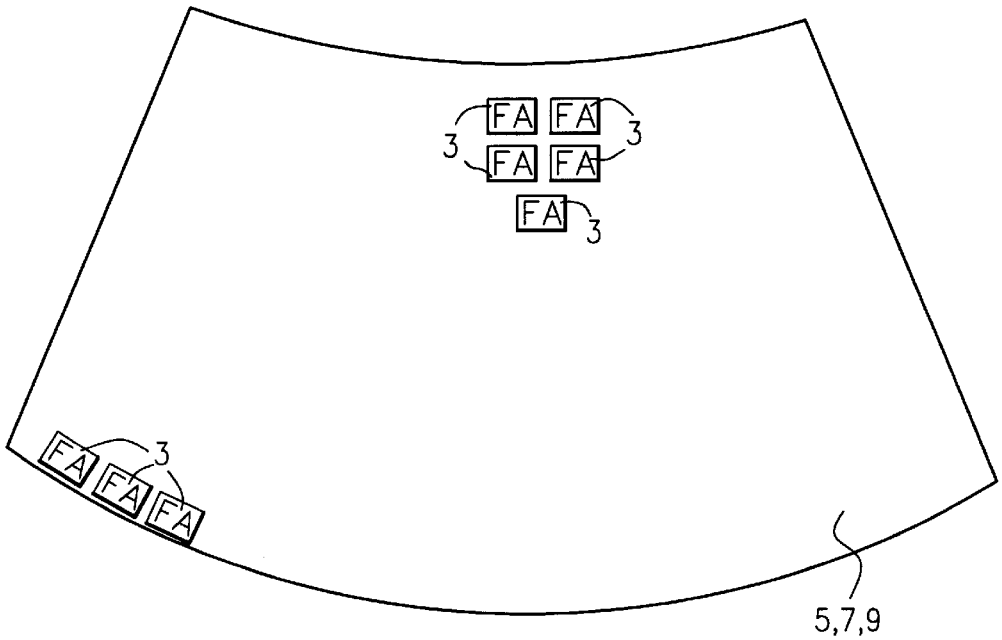
FIG. 4 is a plan view of a vehicle windshield including an array of fractal antennas according to another embodiment of this invention.

FIG. 3 is a plan view of a windshield according to any of the FIG. 1–2 embodiments of this invention. As shown, a single fractal antenna (FA) 3 may be located at an upper portion of the windshield (i.e., near where a rearview mirror is to be attached thereto) so that it is not located in a primary viewing area of the windshield. FIG. 4 illustrates that instead of a single fractal antenna, an array(s) of fractal antennas 3 may be provided on the windshield in any of the manners described herein. One array may be provided at an upper portion of the windshield, and another array at a bottom portion of the windshield as in FIG. 4 (e.g., one array for a first frequency band, and another array for another frequency band). In other embodiments, only a single array may be provided either at the upper portion or the lower portion of the windshield.

Figure 5A:
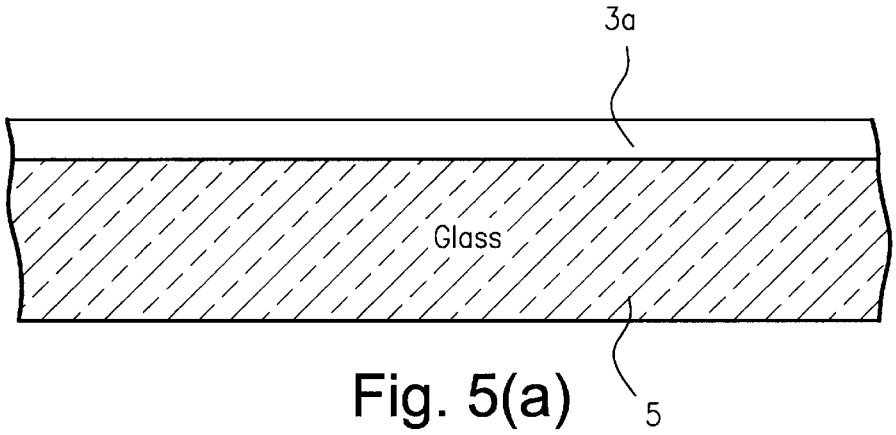
FIG. 5(*a*) is a cross sectional view of conductive layer on a substrate during the process of manufacturing a fractal antenna system according to an embodiment of this invention.
Figure 5B:
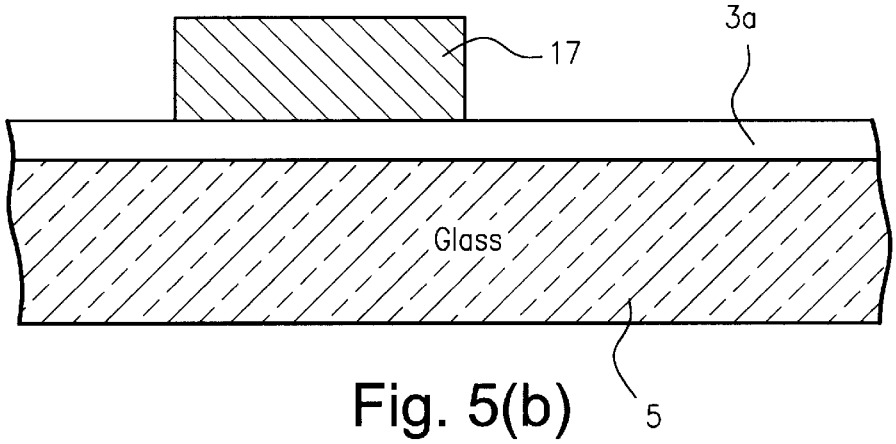
Figure 5C:
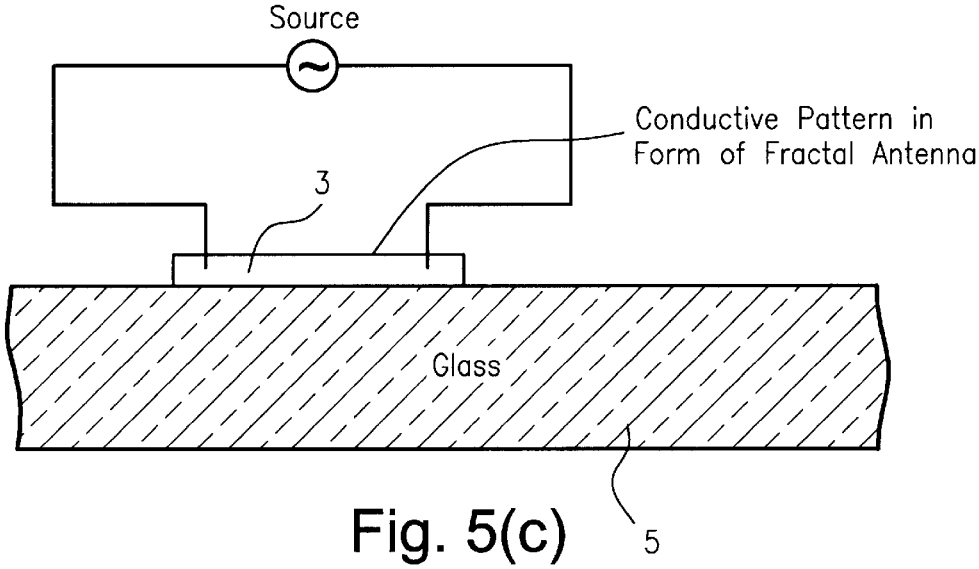
Figure 7A:
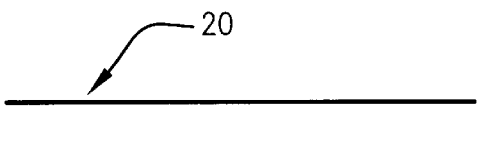
FIGS. 7(*a*), 7(*b*), 7(*c*), and 7(*d*) illustrate development of fractals which may be used as antennas in any of the FIG. 1–4 embodiments herein.
Figure 7B:
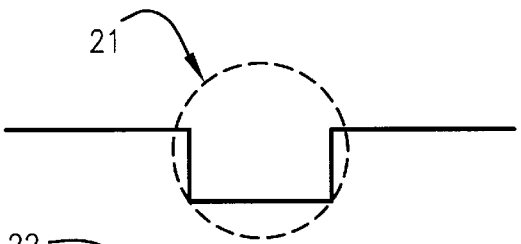
Figure 7C:
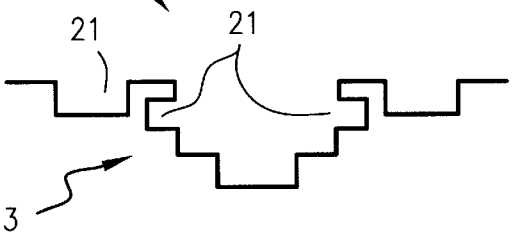
Figure 7D:
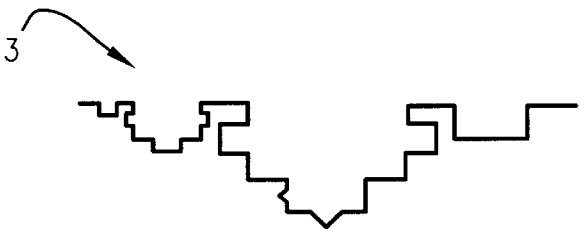
Figure 6A:
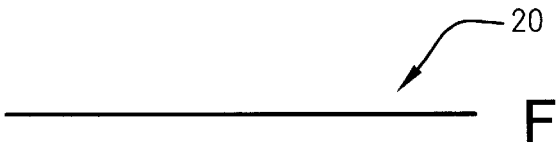
FIGS. 6(*a*), 6(*b*), 6(*c*), and 6(*d*) illustrate development of fractals which may be used as antennas in any of the FIG. 1–4 embodiments herein.
Figure 6B:
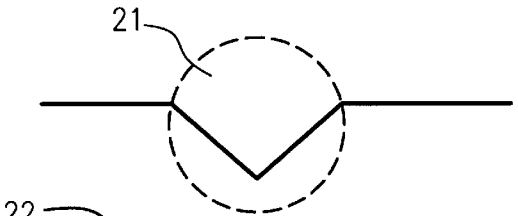
Figure 6C:
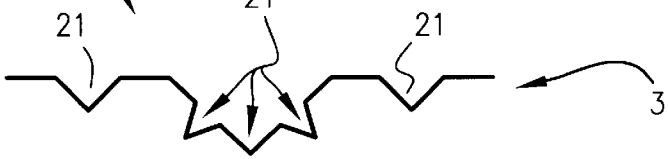
Figure 6D:
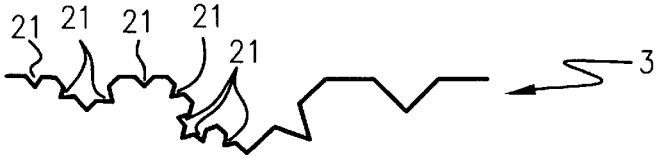

FIGS. 5(*a*) through 5(*c*) illustrates how a fractal antenna 3 may be formed during the context of making a windshield according to the FIG. 1 embodiment of this invention. Glass substrate 5 is provided. A conductive layer 3*a* (e.g., Au, Cu, ITO, other TCO, or the like) is formed on an entire surface of substrate 5 as shown in FIG. 5(*a*). Thereafter, a photoresist 17 is formed and patterned (negative or positive resists may be used) over layer 3*a* using conventional techniques. In FIG. 5(*b*), the resist 17 covers the fractal-shaped portion of layer 3*a* which is to ultimately remain on the substrate. Then, the exposed portion of layer 3*a* is removed using known photolithography techniques (e.g., using UV exposure and/or stripping), thereby leaving only fractal-shaped layer portion 3 on substrate 5 as shown in FIG. 5(*c*). Thereafter, electrical connector(s) may be attached to fractal antenna 3. Then, substrate 5 with fractal antenna 3 thereon is laminated to the opposing substrate 7 via polymer inclusive interlayer 9 to form the windshield of FIG. 1.

FIGS. 6–12 illustrate different fractal antennas (or antennae) 3, any of which may be used in any of the FIG. 1–4 embodiments of this invention. Other shaped fractals may also be used.

As for FIGS. 6(*a*)–6(*d*), FIG. 6(*a*) illustrates a base element 20 in the form of a straight line or trace (a curve could instead be used). In FIG. 6(*b*), a so-called Koch fractal motif or generator 21 (a partial triangle or V-shape in this case) is inserted into the base element to form a first order iteration (i.e., the first or number one iteration, or N=1). In FIG. 6(*c*), a second order (N=2) iteration 22 results from replicating the motif 21 of FIG. 6(*b*) into each straight segment of FIG. 6(*b*). However, the FIG. 6(*c*) fractal is reduced in size (i.e., differently scaled). In FIG. 6(*d*), the left-hand half has been subjected to a third order iteration (N=3) and scaling down, while the right-hand half has not for purposes of illustration. In other words, in the left-hand side of FIG. 6(*d*) the motif 21 has been inserted into each straight segment, and then a corresponding scaling down has been carried out. The right-hand half has been left alone in FIG. 6(*d*). Thus, the left half of FIG. 6(*d*) is known as a third order iteration (N=3) of the fractal, while the right half is known as a second order (N=2) iteration.

FIGS. 7(*a*)–7(*d*) follow the process of FIGS. 6(*a*)–6(*d*), except that the motif 21 is a partial rectangle instead of V-shaped. Thus, FIG. 7(*c*) represents a second order (N=2) fractal iteration. The left half of FIG. 7(*d*) is a third order iteration (N=3) of the fractal, while the right half is a second order (N=2) iteration, for purposes of example illustration. However, it is noted that while in FIG. 7(*d*) the left half is an N=3 iteration; in the center portion a V-shaped motif has been added. The iterations may go on and on (i.e., N may increase up to 10, up to 100, up to 1,000, etc.) in different embodiments of this invention. Preferably, fractal antennas 3 herein take the shape of any fractal iteration herein, of N=2 and higher.

Figure 8A:
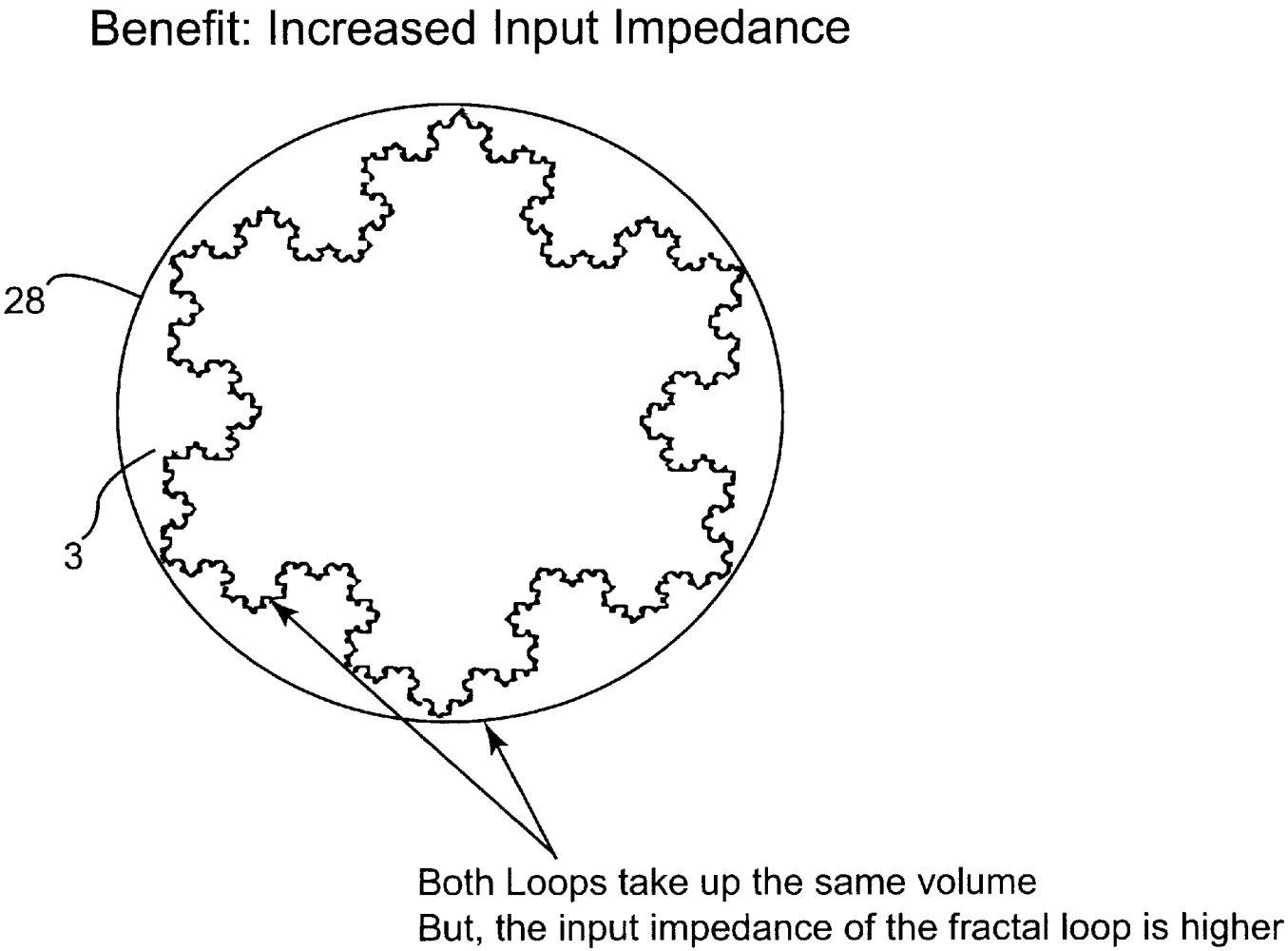
FIG. 8(*a*) illustrates a Euclidean loop antenna laid over a fractal antenna for purposes of comparison, where the fractal antenna may be used in any of the FIG. 1–4 embodiments herein.
Figure 8B:
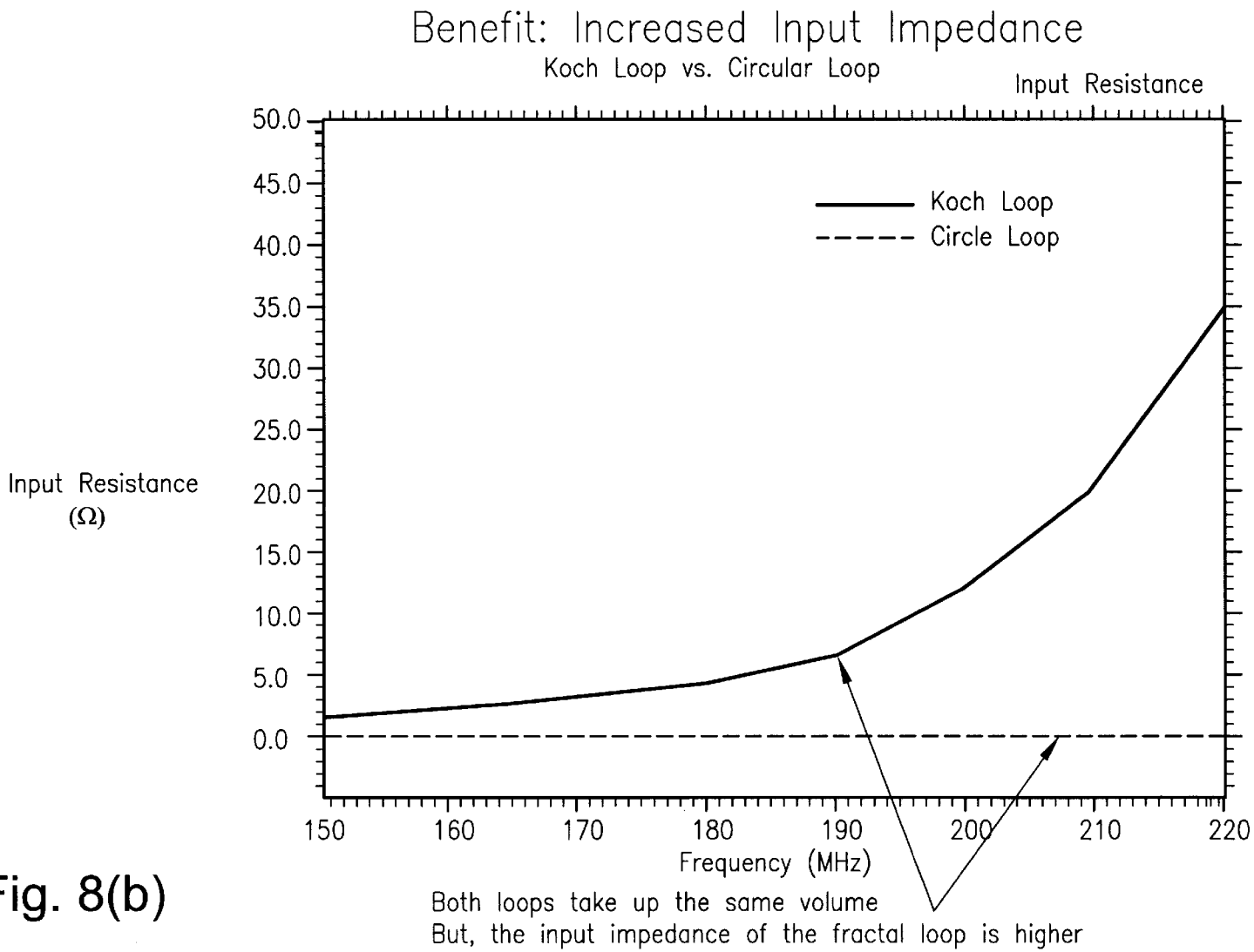

FIG. 8(*a*) illustrates a loop shaped Koch fractal antenna 3 and a loop shaped Euclidean antenna 28 overlaid with one another, where both take up about the same volume or extent. However, it can be seen from FIG. 8(*b*) that the input impedance of the fractal loop 3 is much higher than that of Euclidean 28, especially as frequency increases. The advantage of a small fractal versus a small Euclidean is clear in this regard, given the above discussion. Again, the fractal shape of FIG. 8(*a*) may be used in any of the FIG. 1–4 embodiments herein.

Figure 9:
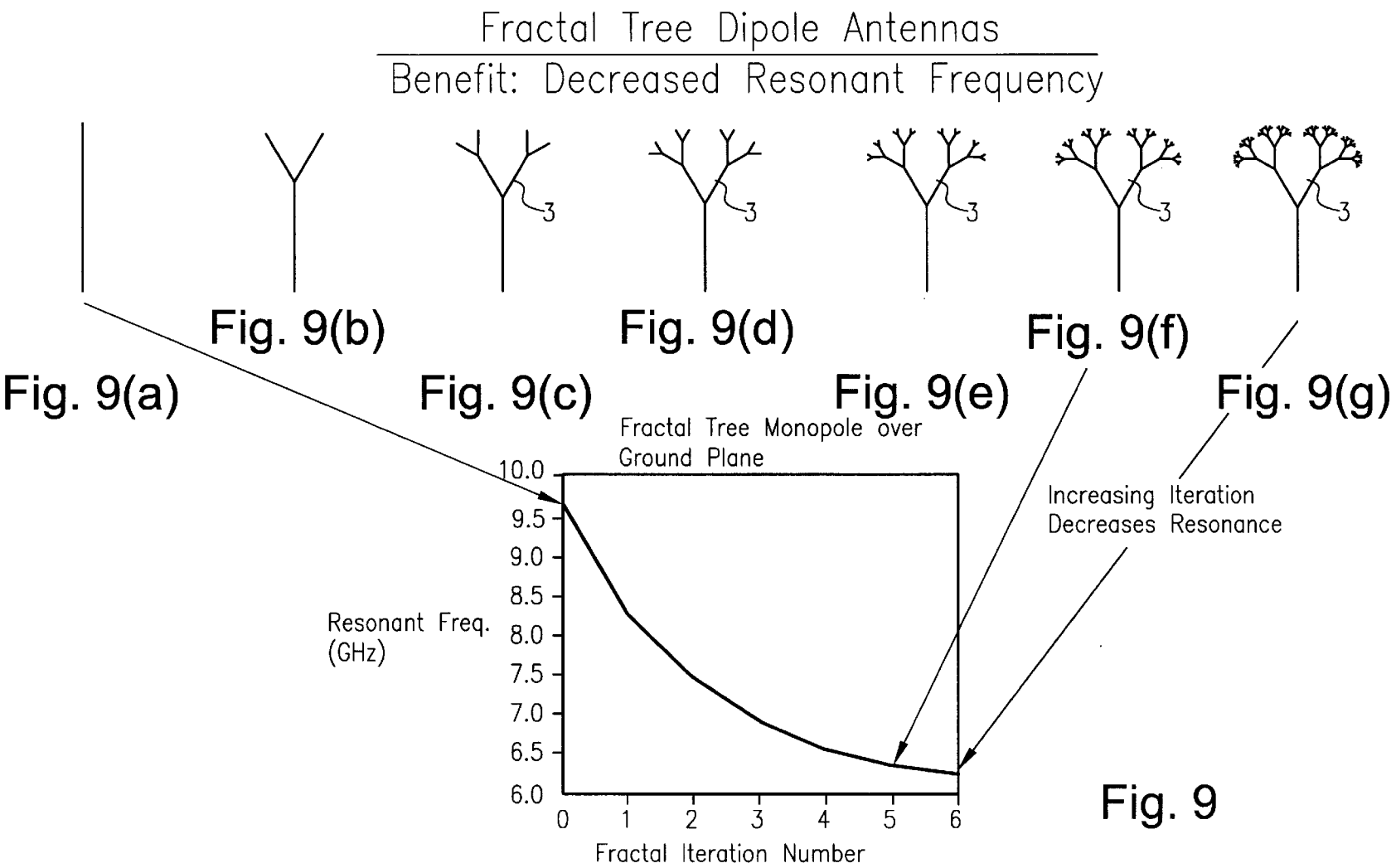
FIG. 9 is a graph plotting fractal iteration number versus resonant frequency, thereby illustrating that resonance decreases as the number of fractal iterations increase.

FIG. 9 illustrates a plurality of tree-shaped dipole fractal antennae of progressive iterations a through g. Iteration a is N=0, iteration b is N=1, iteration c is N=2, and so on until iteration g is N=6. It can be seen with this type of fractal antenna 3 design, resonance decreases as the iterations increase. In a similar manner, FIGS. 10(*a*) through 10(*e*) illustrate iterations N=0 through N=4 of a three dimensional tree dipole type fractal antenna 3. The corresponding graph of FIG. 10(*f*) illustrates that resonance decreases as iterations increase. Again, the fractals of FIGS. 9–10 may be used as antenna(s) 3 in any of the embodiments of FIGS. 1–4.

Figure 11:
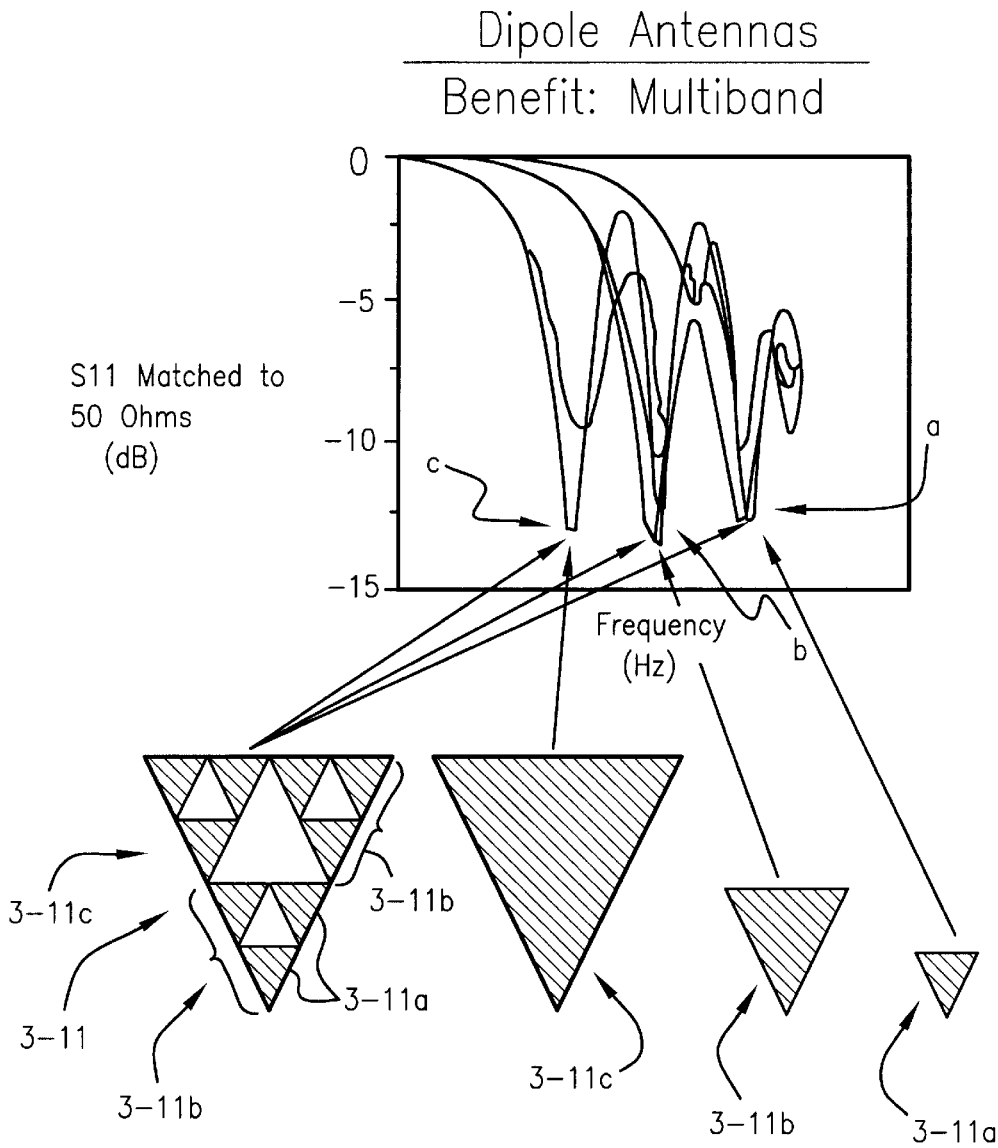
FIG. 11 illustrates a multiband fractal antenna, and corresponding graph, where the multiband fractal antenna may be used in any of the FIG. 1–4 embodiments of this invention.

FIG. 11 illustrates what is believed to be a novel and unique fractal design, intended for multiband use/functionality. Fractal antenna (or antennae) 3-11 may be used in any of the embodiments of FIGS. 1–4, or in any other use or application where a fractal antenna is desired. Multiband fractal antenna 3-11 includes a conductive area (illustrated in black) and a gap or space area of no conductivity (illustrated in white where the conductive layer 3 has been removed from the underlying substrate via photolithography or the like). Fractal antenna 3-11 includes a plurality of triangular motifs or generators located within one another in order to attain the desired multiband capability. In the specific embodiment of FIG. 11, fractal antenna 3-11 includes an array of nine antenna portions 3-11*a* of a same or common first small size, an array of three antenna portions 3-11*b* of an intermediate size (size is defined by perimeter or area within the conductive perimeter), and one large antenna portion 3-11*c* that is defined by the conductive perimeter of the entire fractal antenna 3-11. As illustrated, the array of small antenna portions 3-11*a* transmits/receives at a first frequency band "a", the array of intermediate antenna portions 3-11*b* transmits/receives at a second frequency band "b" separate and distinct from the first band, and the large antenna portion 3-11*c* transmits/receives at a third frequency band "c" different from the first and second bands. In the fractal design of antenna 3-11, the overall antenna includes conductive perimeters of all three antenna portions 3-11*a*, 3-11*b*, and 3-11*c*, and thus can operate at the corresponding different frequency bands (i.e., a multi-band fractal antenna). For example, one frequency band (e.g., band "a") may be for a cell phone, another band for the vehicle radio, and so on. In this embodiment, the conductive peripheries of antenna portions 3-11*a* help make up the conductive perimeters of antenna portions 3-11*b*, and the conductive peripheries of antenna portions 3-11*a* and 3-11*b* help define and make up the conductive perimeter of antenna portion 3-11*c*.

Surprisingly, it has been found that when triangles 3-11*a*, 3-11*b*, and 3-11*c* are isosceles (i.e., only two of the three sides are equal in length), it is much easier to vary frequency. In the illustrated FIG. 11 embodiment, the base of each triangular antenna portion is shorter than the other two sides. Thus, in preferred embodiments, isosceles triangular shapes are used.

Figure 12:
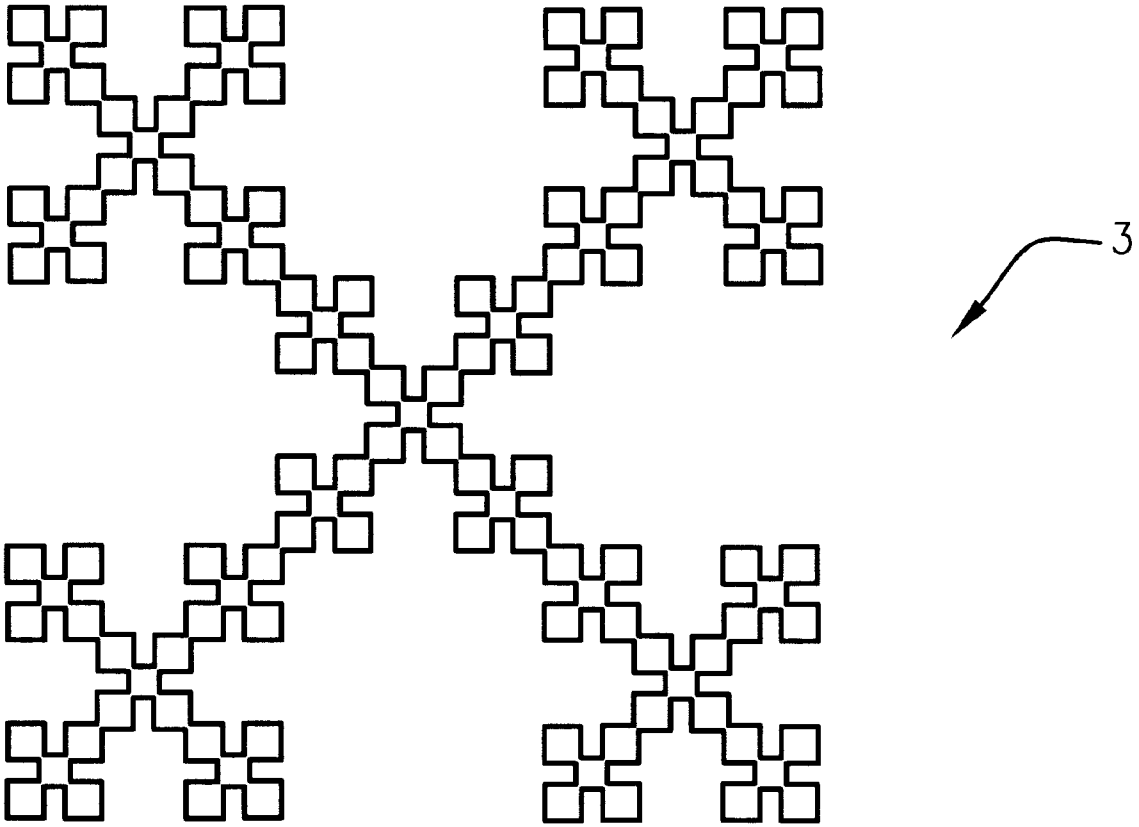
FIG. 12 illustrates a fractal antenna which may be used in any of the FIG. 1–4 embodiments of this invention.

FIG. 12 illustrates another fractal antenna 3 which may be used in any of the FIG. 1–4 embodiments of this invention. For a more detailed discussion of the fractal of FIG. 12, see the aforesaid '349 patent.

Figure 13A:
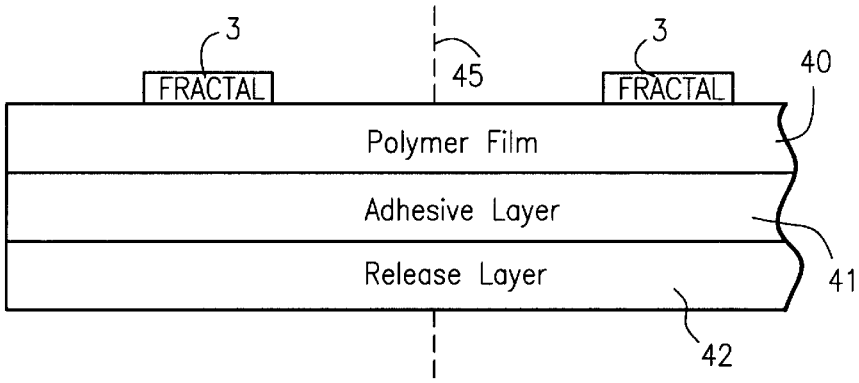
FIGS. 13(*a*)–13(*c*) are side cross sectional views of articles in the process of making a vehicle window according to another embodiment of this invention.
Figure 13B:
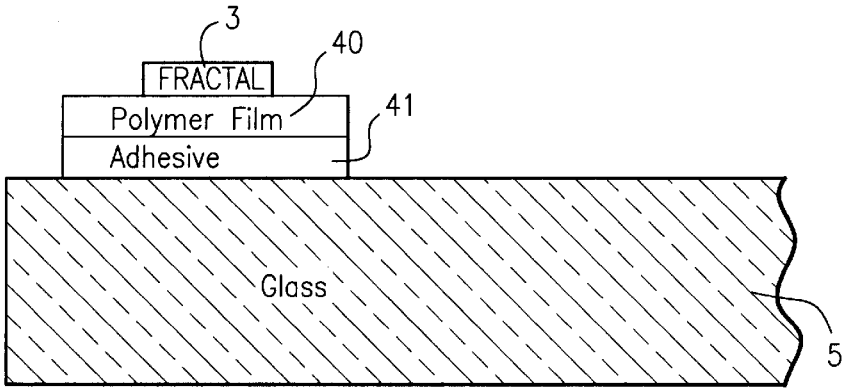
Figure 13C:
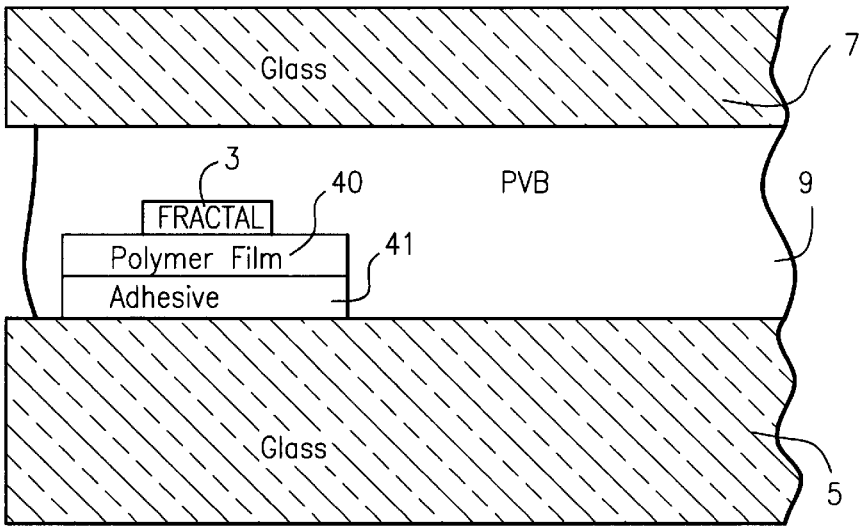

FIGS. 13(*a*), 13(*b*) and 13(*c*) illustrate another way in which vehicle windows may be made according to certain embodiments of this invention. First, as shown in FIG. 13(*a*), one or more fractal antenna(s) 3 are printed on polymer (e.g., PET) film 40. Polymer inclusive film 40 also supports adhesive layer 41 and backing/release layer 42. If many antennae 3 are printed on film 40 (e.g. via silk-screen printing, or any other suitable technique), then the coated article may be cut into a plurality of different pieces as shown by cutting line 45. After cutting (which is optional), release layer 42 is removed (e.g., peeled off), and film 40 with fractal antenna(s) 3 printed thereon is adhered to substrate 5 via exposed adhesive layer 41 (see FIG. 13(*b*)). Thereafter, the FIG. 13(*b*) structure is laminated to the other substrate 7 via PVB interlayer 9. In such a manner, fractal(s) 3 can be more easily formed in the resulting vehicle window that is shown in FIG. 13(*c*). Electrical leads to fractal(s) 3 are now shown in FIG. 13 for purposes of simplicity. Moreover, in alternatives of this embodiment, a low-E coating 15 may be provided on the interior surface of the other substrate 7 in certain instances. Even though fractal(s) 3 is printed onto film/layer 40 prior to lamination in this embodiment, fractal (s) 3 is/are still considered to be "on" and "supported by" substrate 5 in the resulting window.

Figure 14A:
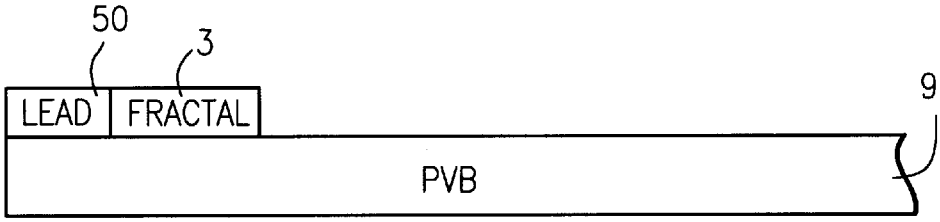
FIGS. 14(*a*)–14(*b*) are side cross sectional view of articles in the process of making a vehicle window according to another embodiment of this invention.
Figure 14B:
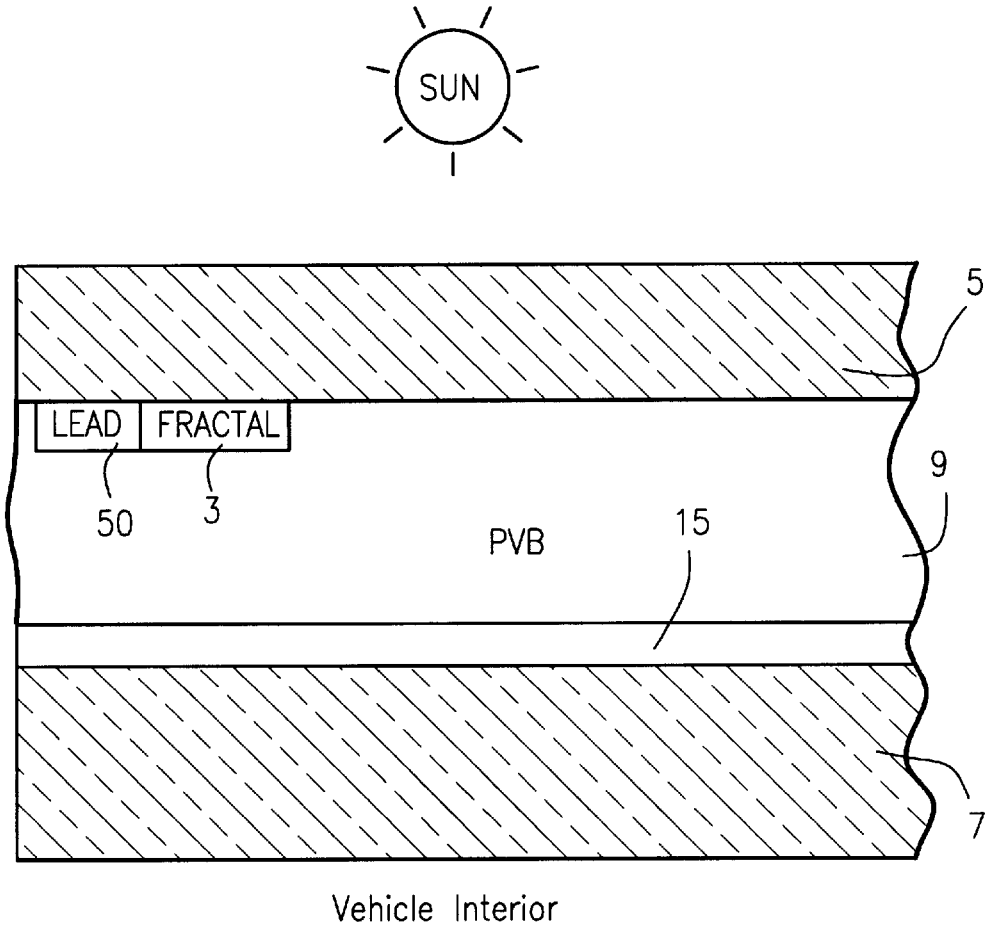

FIGS. 14(*a*)–14(*b*) illustrate how vehicle windows may be made according to still other embodiments of this invention. First, as shown in FIG. 14(*a*), fractal antenna(s) 3 is/are printed on interlayer 9. Polymer inclusive interlayer 9 may be of or include PVB, or any other suitable material. Conductive fractal layer 3 may be printed on interlayer 9 via silk-screen printing, or any other suitable technique. Optionally, leads 50 to fractal(s) 3 may also be printed on interlayer 9 at this time along with the fractal(s). One, or an array, of fractal(s) 3 may be printed on interlayer 9. Thereafter, substrates 5 and 7 are laminated to one another via the interlayer of FIG. 14(*a*), so as to result in the vehicle window of FIG. 14(*b*). Lead(s) 50 extend to location(s) proximate an edge of the window, so that they may be connected to terminal connectors as will be appreciated by those skilled in the art. Even though fractal(s) 3 is printed onto interlayer 9 prior to lamination in this embodiment, fractal(s) 3 is/are still considered to be "on" and "supported by" substrate 5 in the resulting window. As can be seen, interlayer 9 is preferably arranged during lamination so that the fractal(s) 3 end up closer to exterior substrate 5 than to interior substrate 7. Optionally, low-E coating 15 may be provided on the other substrate 7 for the advantageous reasons discussed above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A vehicle windshield comprising:

first and second substrates laminated to one another via at least a polymer inclusive interlayer, the first substrate being an exterior substrate and the second substrate being an interior substrate where the exterior substrate is further from an interior of the vehicle than is the interior substrate;

at least one fractal antenna located at least partially between said interior and exterior substrates, wherein said fractal antenna is supported by the exterior substrate so as to be located between the exterior substrate and the polymer inclusive interlayer; and a low-E coating including at least one layer comprising Ag provided on the interior substrate so as to be located between the interior substrate and the polymer inclusive interlayer, so that the fractal antenna and the low-E coating are on opposite sides of the polymer inclusive interlayer.

2. The windshield of claim 1, wherein said first and second substrates are glass substrates.

3. The windshield of claim 1, wherein said interlayer comprises polyvinyl butyral (PVB).

4. The windshield of claim 1, wherein said fractal antenna includes a substantially transparent conductive layer on an interior surface of said first substrate, and wherein said substantially transparent conductive layer is in direct contact with said polymer inclusive interlayer.

5. The windshield of claim 4, wherein said substantially transparent conductive layer is in direct contact with said first substrate.

6. The windshield of claim 5, wherein said substantially transparent conductive layer comprises substantially transparent conductive oxide (TCO).

7. The windshield of claim 1, wherein said fractal antenna comprises a first group of antennas each in the shape of an isosceles triangle and a second antenna also in the shape of an isosceles triangle, wherein said first group of antennas is located within a perimeter or periphery of said second antenna.

8. The windshield of claim 7, wherein said fractal antenna is a multiband antenna where said first group of antennas transmits and/or receives at a first frequency band, and said second antenna transmits and/or receives at a second frequency band that is different from said first frequency band.

9. The windshield of claim 1, wherein said fractal antenna comprises a plurality of triangular shaped antenna portions located within a periphery or perimeter of another triangular shaped antenna portion, wherein said another triangular shaped antenna portion is larger than each of said plurality of triangular shaped antenna portions.

10. The windshield of claim 1, wherein said layer comprising Ag of the low-E coating system is a conductive infrared (IR) reflecting layer supported by the interior substrate.

11. The windshield of claim 10, wherein said conductive IR reflecting layer of said low-E coating system is used as a ground plane for said fractal antenna.

12. A method of making a vehicle windshield, the method comprising:

providing first and second substrates;

forming a first conductive layer on the first substrate;

forming a resist on the first substrate over the first conductive layer;

patterning the first conductive layer into a shape of a fractal antenna using the resist, thereby leaving the fractal antenna on the first substrate;

forming a low-E coating including at least one IR reflecting layer on the second substrate; and laminating the first substrate with the fractal antenna thereon to the second substrate via a polymer inclusive layer, so that the fractal antenna and the low-E coating are supported by opposite substrates with the polymer inclusive layer therebetween.

13. The method of claim 12, wherein the first and second substrates are glass substrates, wherein the first substrate is an exterior substrate and the second substrate is an interior substrate.

14. The method of claim 12, further comprising heat bending each of the first and second substrates so as to form a curved windshield.

15. The method of claim 12, wherein the IR reflecting layer of the low-E coating comprises Ag.

16. The method of claim 15, further comprising using the at least one conductive layer of the low-E coating as a ground plane for the fractal antenna.

17. A method of making a vehicle window, the method comprising:

printing a fractal conductive antenna layer on a polymer inclusive film, said polymer inclusive film also supporting an adhesive layer and a release layer;

removing the release layer, and adhering the polymer inclusive film with the fractal conductive antenna layer thereon to a substrate; and laminating the substrate to another substrate via a polymer inclusive interlayer in the process of forming a vehicle window, so that a low-E coating and the fractal antenna layer are spaced apart from one another with the polymer inclusive interlayer therebetween.

18. The method of claim 17, wherein the polymer inclusive interlayer comprises PVB.

19. The method of claim 17, wherein the polymer inclusive film comprises PET.

20. A method of making a vehicle window, the method comprising:

forming a fractal layer on a polymer inclusive layer; and after forming the fractal layer on the polymer inclusive layer, laminating first and second substrates to one another via the polymer inclusive layer so that following said laminating the fractal layer is sandwiched between the substrates.

21. The method of claim 20, wherein the polymer inclusive layer comprises PVB, and is an interlayer in the resulting vehicle window.

22. The method of claim 21, further comprising printing conductive leads on the polymer inclusive layer at the same time as the fractal layer is formed on the polymer inclusive layer.

* * * * *